US009827733B2

(12) United States Patent
Saito

(10) Patent No.: US 9,827,733 B2
(45) Date of Patent: Nov. 28, 2017

(54) APPARATUS FOR PERFORMING BINDING PROCESSING ON SHEETS AND POST-PROCESSING APPARATUS PROVIDED WITH THE SAME

(71) Applicant: Takashi Saito, Yamanashi-ken (JP)

(72) Inventor: Takashi Saito, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 237 days.

(21) Appl. No.: 14/743,498

(22) Filed: Jun. 18, 2015

(65) Prior Publication Data

US 2015/0368063 A1 Dec. 24, 2015

(30) Foreign Application Priority Data

Jun. 19, 2014 (JP) ..... 2014-126084

(51) Int. Cl.

| | |
|---|---|
| ***B31F 1/07*** | (2006.01) |
| ***B65H 37/04*** | (2006.01) |
| ***B65H 39/00*** | (2006.01) |
| ***B65H 31/34*** | (2006.01) |
| ***B31F 5/02*** | (2006.01) |
| ***G03G 15/00*** | (2006.01) |
| ***B42B 5/00*** | (2006.01) |

(52) U.S. Cl.

CPC ..... *B31F 1/07* (2013.01); *B31F 5/02* (2013.01); *B42B 5/00* (2013.01); *B65H 31/34* (2013.01); *B65H 37/04* (2013.01); *B65H 39/00* (2013.01); *G03G 15/6544* (2013.01); *B65H 2301/43828* (2013.01); *B65H 2301/51616* (2013.01); *B65H 2801/27* (2013.01); *G03G 2215/00852* (2013.01)

(58) Field of Classification Search

CPC ... B31F 1/07; B31F 5/02; G03G 2215/00852; B65H 2301/51616; B65H 31/34; B65H 9/04; B65H 9/06; B65H 37/04; B65H 39/00

USPC ..... 270/58.07, 58.08, 58.11, 58.12, 58.17, 270/58.27

See application file for complete search history.

(56) References Cited

U.S. PATENT DOCUMENTS

| | | | | |
|---|---|---|---|---|
| 8,246,033 | B2 * | 8/2012 | Sato | 270/58.09 |
| 2013/0154178 | A1 * | 6/2013 | Suzuki et al. | 270/58.08 |
| 2013/0264762 | A1 * | 10/2013 | Matsushita et al. | 270/58.08 |

FOREIGN PATENT DOCUMENTS

| | | | |
|---|---|---|---|
| JP | 2004168435 | A * | 6/2004 |
| JP | 5253453 | B | 4/2013 |
| JP | 2014-73681 | A | 4/2014 |

* cited by examiner

*Primary Examiner* — Leslie A Nicholson, III
(74) *Attorney, Agent, or Firm* — Manabu Kanesaka

(57) ABSTRACT

In performing press binding with a pair of pressurizing surfaces opposed to each other with sheets nipped therebetween, one of the pressurizing surfaces is configured to shift to positions relatively to the other pressurizing surface, and a shift section is provided in the pressurizing surface that shifts to positions. An apparatus for applying narrow pressure to a plurality of sheets with a pair of pressurizing surfaces to perform press binding is provided with first and second pressurizing surfaces opposed to each other with sheets nipped therebetween, and a pressurization driver that shifts a position of at least one of the first and second pressurizing surfaces from a waiting position separated to an actuation position for coming into press-contact.

8 Claims, 9 Drawing Sheets

Ce1; HIGH PRESSURIZATION FORCE
Ce2; LOW PRESSURIZATION FORCE

A; FIRST REFERENCE CURRENT VALUE (STRONG BINDING)
B; SECOND REFERENCE CURRENT VALUE (WEAK BINDING)
A > B

APPARATUS FOR PERFORMING BINDING PROCESSING ON SHEETS AND POST-PROCESSING APPARATUS PROVIDED WITH THE SAME

RELATED APPLICATIONS

The present application is based on, and claims priority from, Japanese Application No. JP2014-126084 filed Jun. 19, 2014, the disclosure of which is hereby incorporated by reference herein in its entirety.

TECHNICAL FIELD

The present invention relates to a sheet post-processing apparatus for binding a plurality of sheets, and more particularly, to improvements in a binding processing mechanism for enabling binding strength to be adjusted.

BACKGROUND OF THE INVENTION

Generally, this type of binding processing apparatus is known as an apparatus that performs binding processing on a bunch of sheets supported on a paper mount (sheet support section) as a post-processing apparatus in an image formation system, or the like. As a binding processing mechanism, known are a mechanism (staple binding mechanism) for binding a bunch of sheets with a staple, and a mechanism (press binding mechanism) for applying narrow pressure to a bunch of sheets with pressurizing surfaces having concavo-convex surfaces to perform press binding.

The press binding mechanism for performing binding processing on a bunch of sheets without using a metal needle is commonly used for a method of enabling bound sheets to be easily separated and divided and not affecting the environment in discarding documents. On the other hand, such a problem is also known that the sheet peels off when a bunch thickness of a bunch of sheets to perform binding processing is thick, page turning is performed vigorously or the like.

For example, Patent Document 1 discloses a press binding mechanism, and proposes the mechanism for increasing or decreasing a press binding region (press-binding area) corresponding to a bunch of sheets to perform binding processing. The Document discloses the mechanism that is a pressurizing mechanism in the shape of gears which rotate in a mutually meshing state in which by adjusting the rotation amount, strong binding is obtained when a band-shaped binding portion is long, and weak binding is obtained when the portion is short.

Further, in Patent Document 2, it is configured to enable strong binding or weak binding to be selected by changing the angle direction of a press binding pressurizing region. Then, in applying narrow pressure to sheets with a pair of pressurizing surfaces to perform press binding, the sheets are deformed in the shape of gathers. Binding easy to peel (weak binding) or binding hard to peel (strong binding) is selected by changing a mesh width (short-side direction) and mesh length (long-side direction) in the arrangement direction with respect to the sheet turning direction.

PATENT DOCUMENT

[Patent Document 1] Japanese Patent Gazette No. 5253453
[Patent Document 2] Japanese Patent Application Publication No. 2014-73681

DISCLOSURE OF INVENTION

Problems to be Solved by the Invention

As the method of performing binding processing on a plurality of sheets without using a staple, such a binding processing method has already been known that narrow pressure is applied to stacked sheets from the frontside and backside directions with concavo-convex-shaped pressurizing surfaces to deform the sheets in the shape of gathers. In this binding processing methods are known the demerit that the binding strength is weak and the merit that it is possible to easily peel off during use.

Then, in such a press binding mechanism, it is attempted to select binding a bunch of sheets strongly or binding weakly to perform binding processing. For example, the mechanism as described in Patent Document 1 adopts the mechanism for applying narrow pressure to a bunch of sheets with pressurizing surfaces in the shape of mutually meshing gears, and is configured to select binding hard to peel with a long binding length or binding easy to peel with a short binding length by changing the rotation amount of the gear-shaped pressurizing surfaces.

In the mechanism (method) for thus changing the binding length in press binding to be long or short, since the binding length of a bunch of sheets is different, in a short binding length, as shown in FIG. 9B, such a problem arises that sheets are easy to turn in page turning.

Further, in the mechanism for changing the press binding direction as described in Patent Document 2, as shown in FIG. 9D, since the binding length direction (long side) is positioned between the sheet corner and the image formed area, such a problem arises that the binding margin portion enters the image formed area.

It is an object of the present invention to provide a sheet binding processing apparatus for enabling strong binding strength or weak binding strength to be selected in a neat sheet posture to perform binding processing, in applying narrow pressure to a plurality of sheets with concavo-convex-shaped pressurizing surfaces to perform the binding processing.

Means for Solving the Problem

To attain the above-mentioned object, in the present invention, in performing press binding with a pair of pressurizing surfaces opposed to each other with sheets nipped therebetween, one of the pressurizing surfaces is configured to shift to positions relatively to the other pressurizing surface, and a shift section is provided in the pressurizing surface that shifts to positions.

Further, the configuration will be described specifically. An apparatus for applying narrow pressure to a plurality of sheets with a pair of pressurizing surfaces to perform press binding is provided with first and second pressurizing surfaces opposed to each other with sheets nipped therebetween, and a pressurization driver that shifts a position of at least one of the first and second pressurizing surfaces from a waiting position separated to an actuation position for coming into press-contact.

The pair of pressurizing surfaces are configured so that one of the pressurizing surfaces shifts to positions relatively to the other pressurizing surface, and a shift section is provided in the pressurizing surface that shifts to positions.

As a configuration of the pressurizing surface capable of shifting to positions, for example, a guide mechanism is provided in a frame member (apparatus frame, bracket or the like), a pressurizing block having the pressurizing surface is configured to be able to shift slidably, and the pressurizing surface is selectively positioned in first and second different positions with a cam mechanism or the like. By this means, with respect to the opposed pressurizing surface, the pressurizing surface in the first position meshes with the opposed pressurizing surface in an entire region, and the pressurizing surface in the second position meshes with the opposed pressurizing surface in a part of the region. Accordingly, the sheets are provided with a pressurization force (press binding force) proportional to a mesh area.

In addition, the mesh area of the pair of pressurizing surfaces adopts a configuration of changing the area in two first and second steps, changing the area in three or more steps stepwise or changing the area in a non-step manner.

Advantageous Effect of the Invention

The present invention is to configure so that one of pressurizing surfaces is able to shift to positions relatively to the other pressurizing surface in performing press binding on sheets with a pair of pressurizing surfaces and to enable a mesh area for press-binding the sheets to be adjusted in two or more steps, and therefore, has the following effects.

Opposed positions of a pair of pressurizing surfaces for press-binding sheets with the sheets therebetween are positioned in positions for increasing the mesh area in a mode of binding hard to peel, and are positioned in positions for decreasing the mesh area in a mode of binding easy to peel. By this means, the present invention enables the binding processing to be executed in any of modes, according to the binding strength set by an operator, binding conditions such as a bunch thickness of sheets and sheet size and the like.

Further, for example, the configuration therefor is a configuration such that a plate member (block member) having the pressurizing surface is attached to a frame member (unit frame, bracket or the like) to be able to shift to positions and that the shift section such as a motor solenoid shifts the positions, and it is thus possible to provide the simplified structure inexpensively. Furthermore, in the present invention, a pair of pressurizing surfaces are formed by arranging pluralities of concavo-convex-shaped tooth forms mutually meshing with one another with a predetermined width in a predetermined length, one of the pressurizing surfaces is configured to be able to shift to positions in the mesh width direction, and therefore, the sheets are easily not peeled in page turning.

Figure 1:
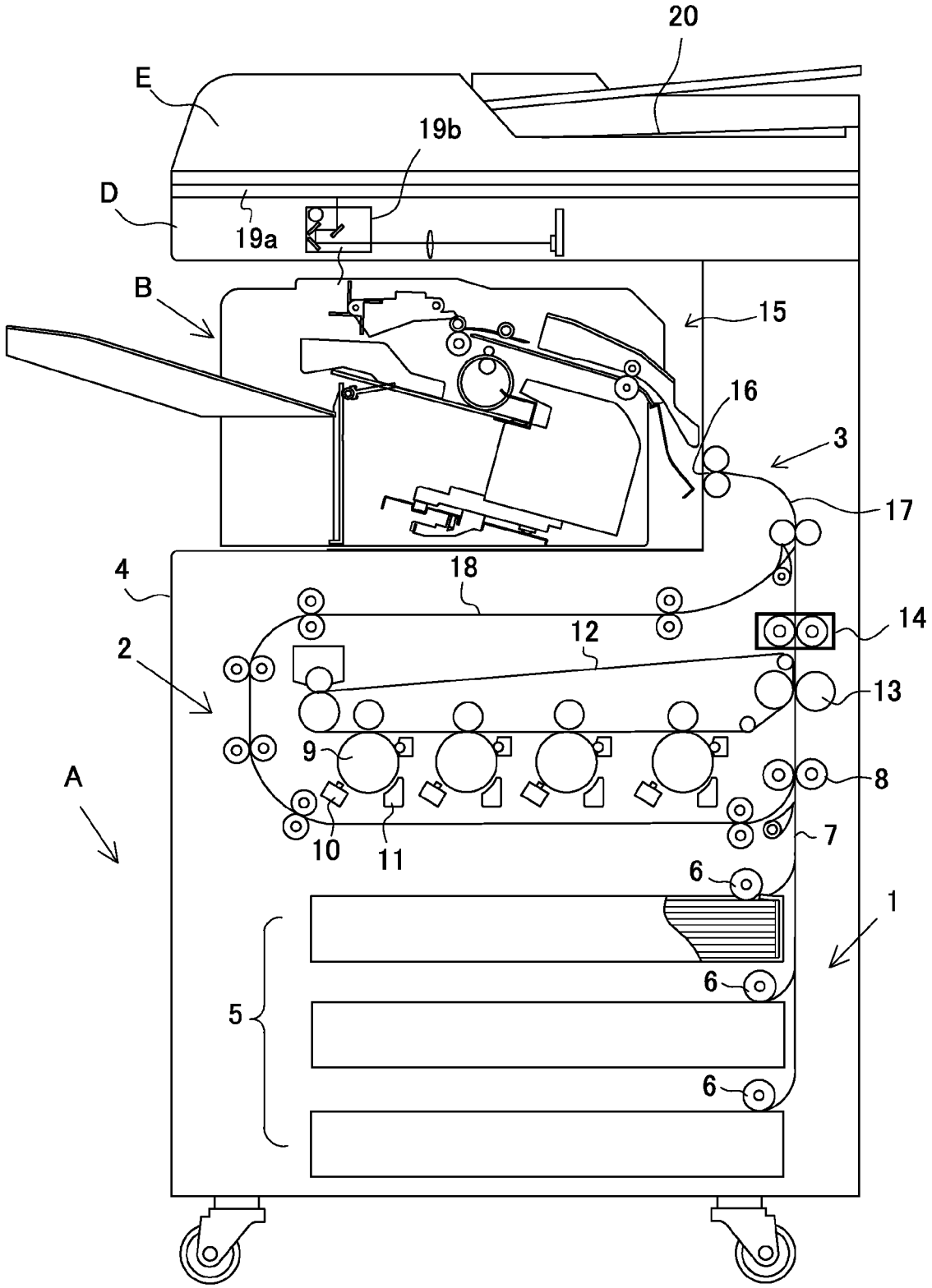
FIG. 1 is an explanatory view of an entire configuration of an image formation system provided with a post-processing apparatus according to the present invention.
Figure 3:
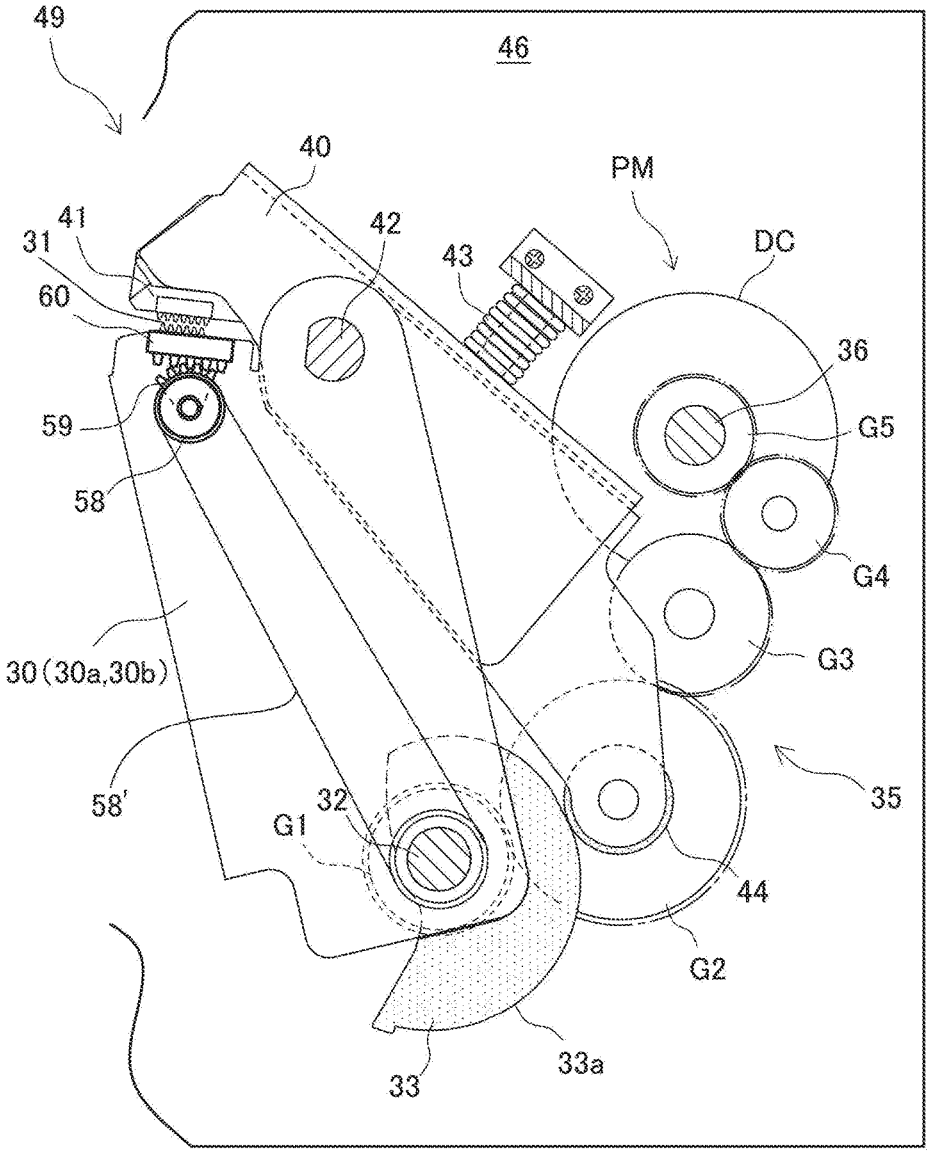
FIG. 3 is a mechanism explanatory view of a sheet binding processing unit (press binding unit) incorporated into the post-processing apparatus of FIG. 2.
Figure 4A:
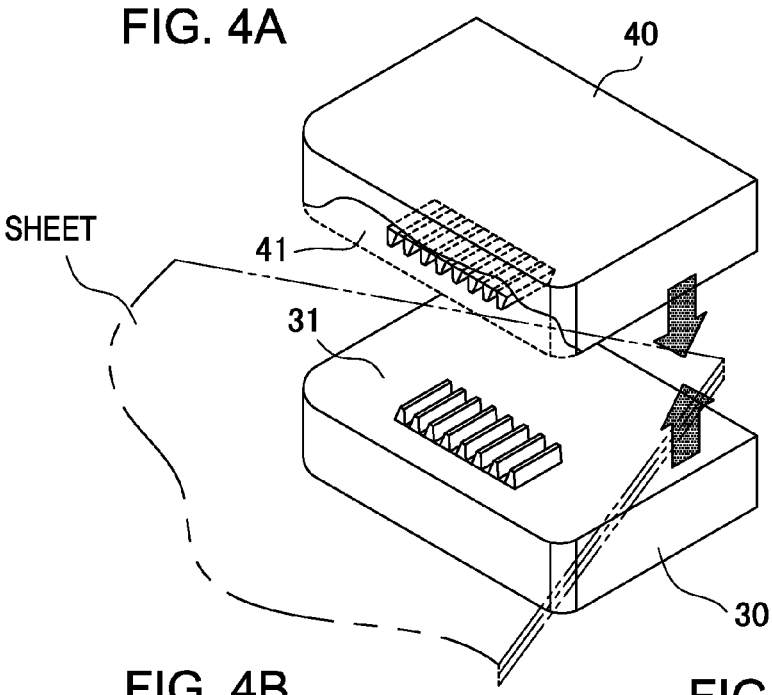
Figure 4B:
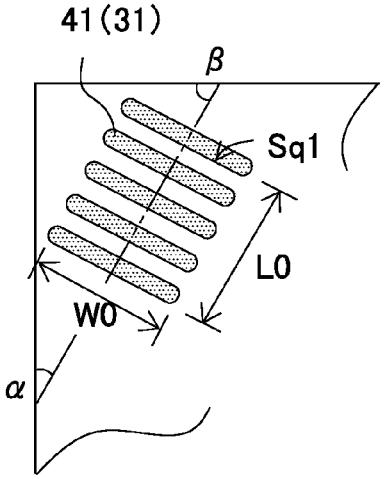
Figure 4C:
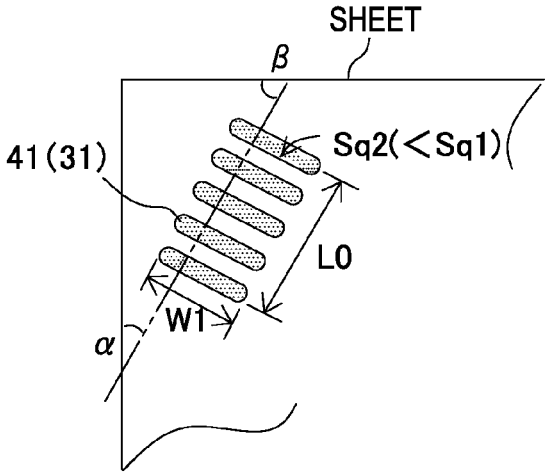
Figure 4D:
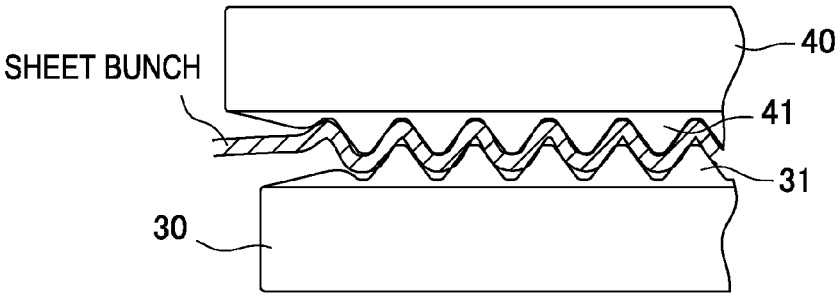
Figure 5A:
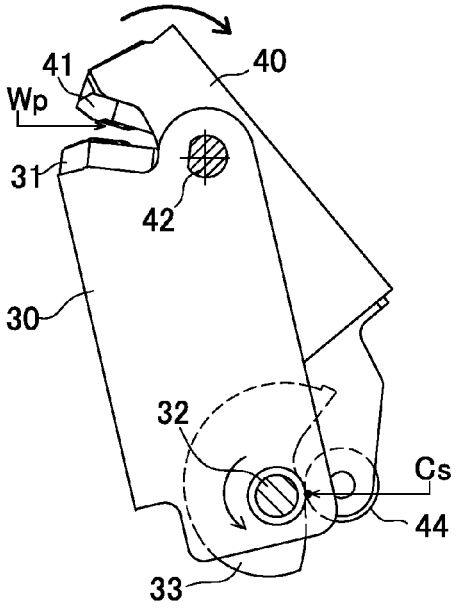
Figure 5B:
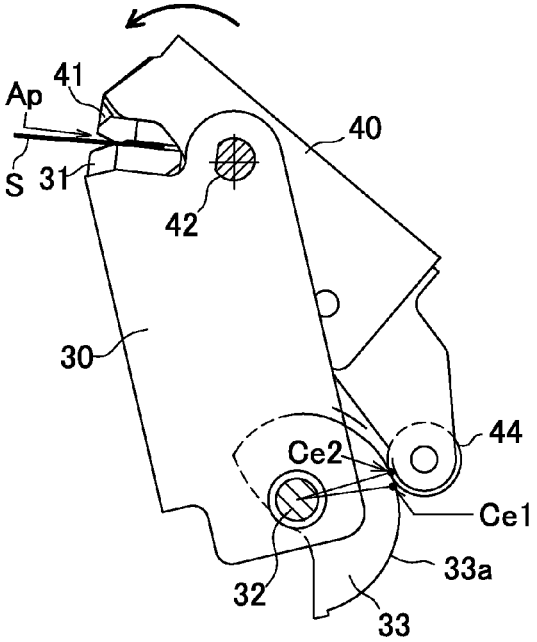
Figure 5C:
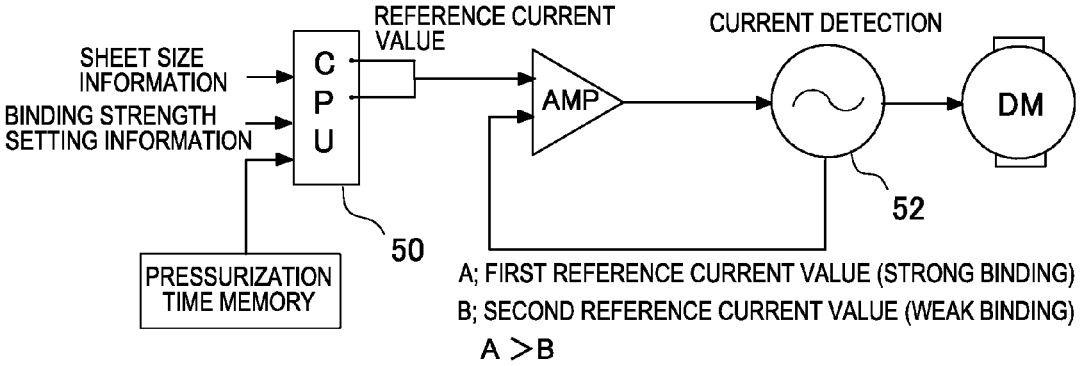
Figure 6A:
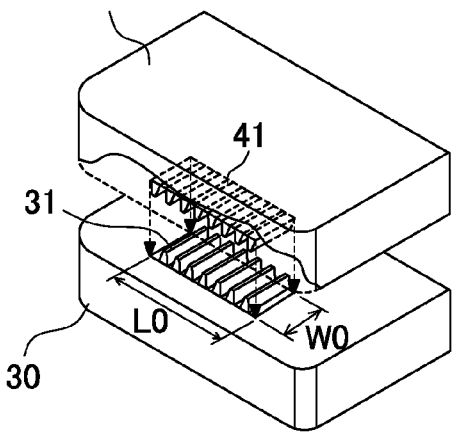
Figure 6B:
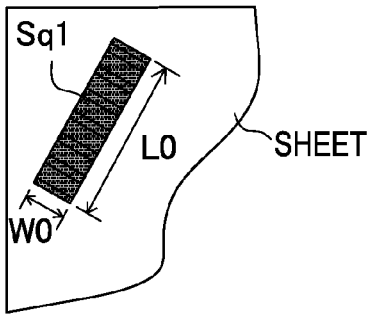
Figure 6C:
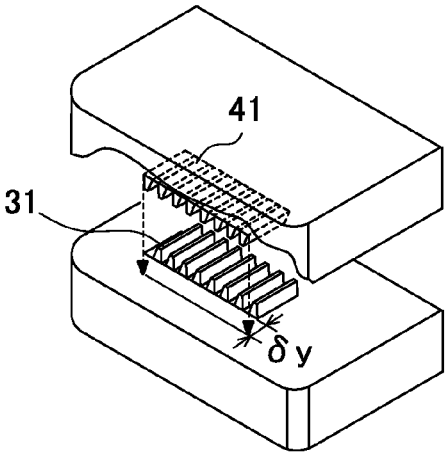
Figure 6D:
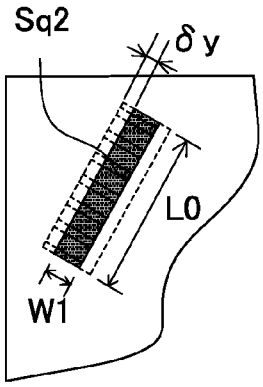
Figure 6E:
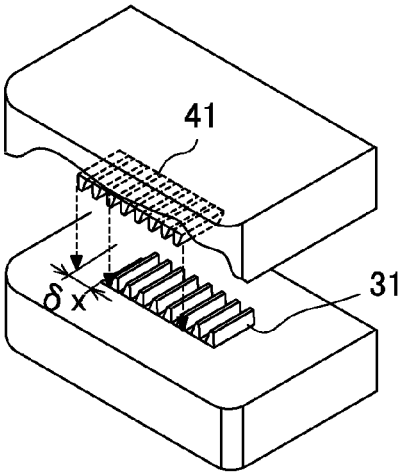
Figure 6F:
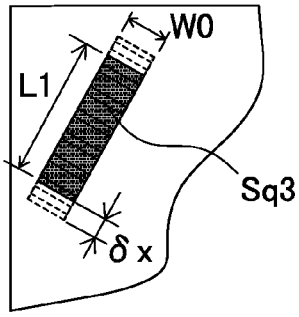
Figure 7:
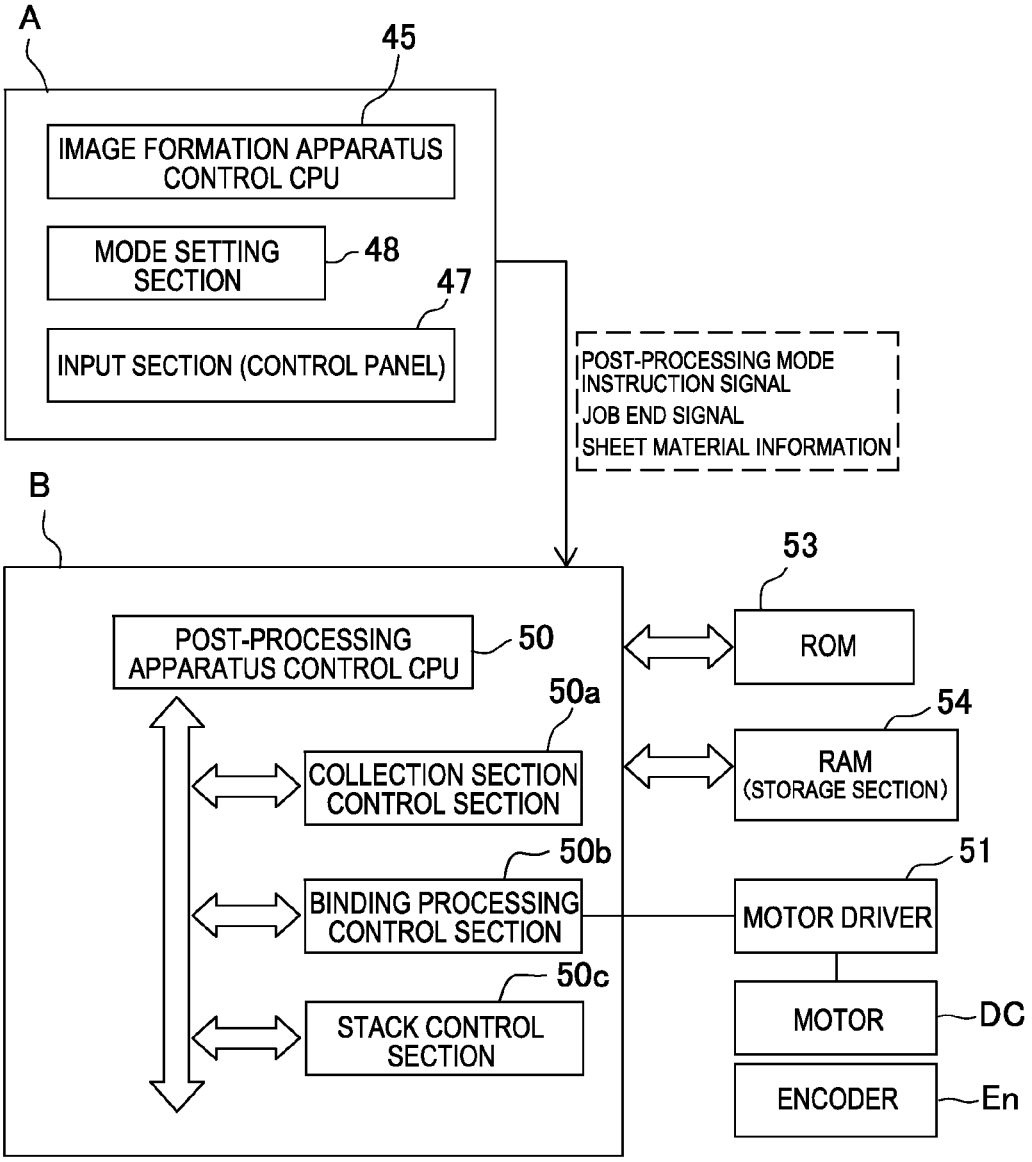
Figure 8:
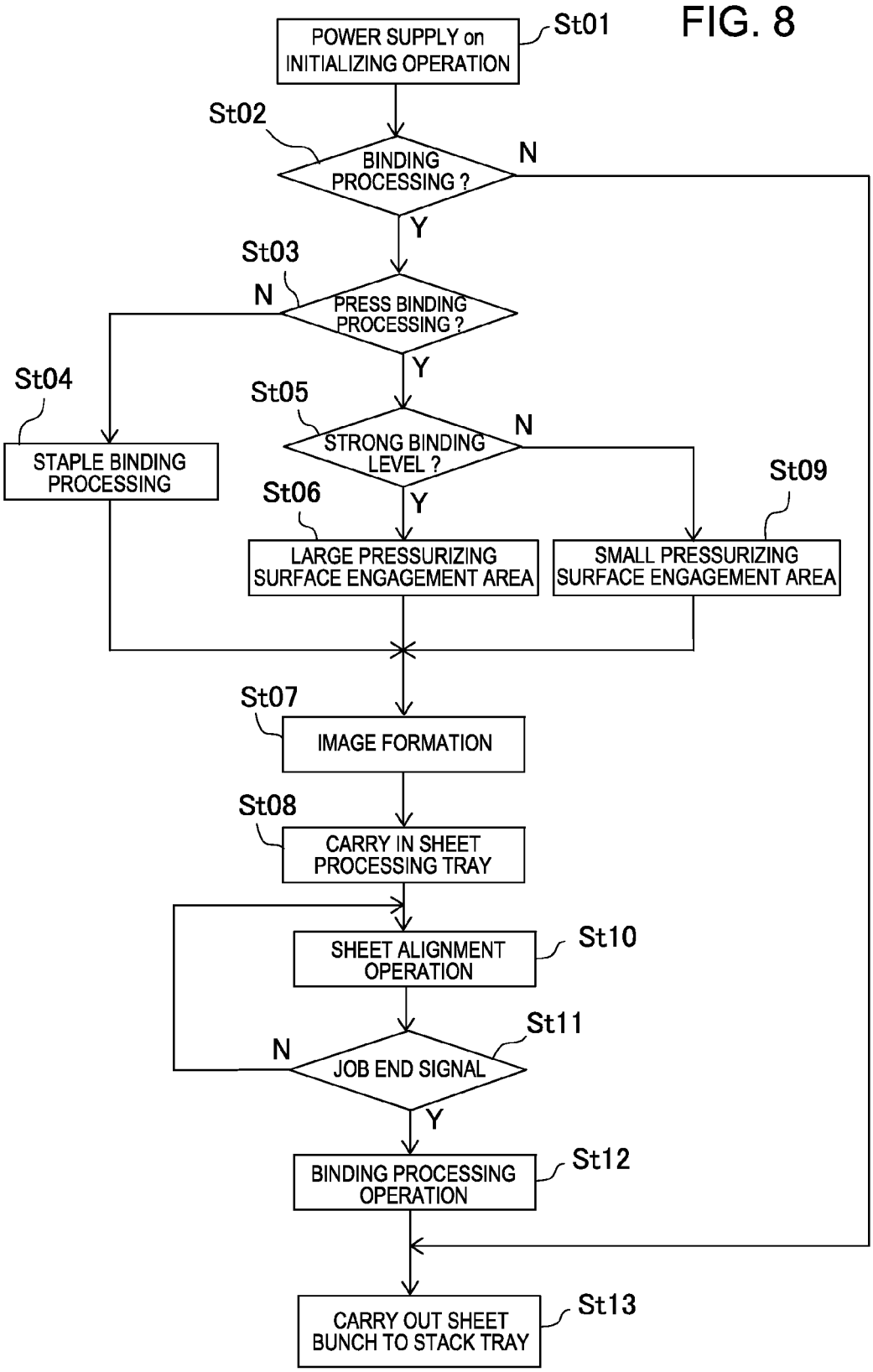
Figure 9A:
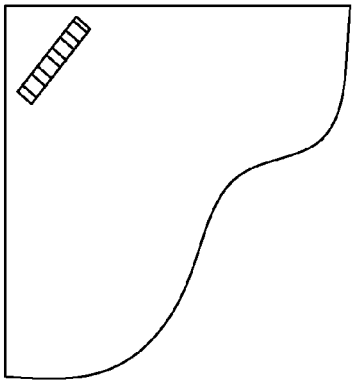
Figure 9B:
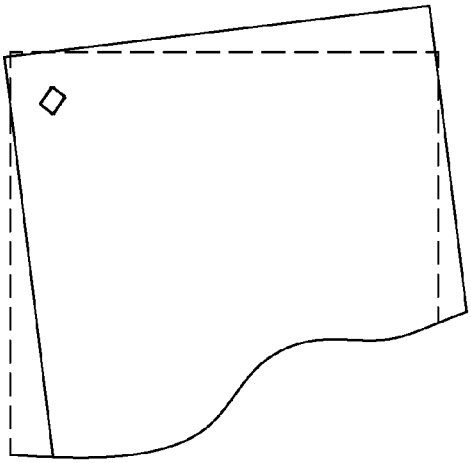
Figure 9C:
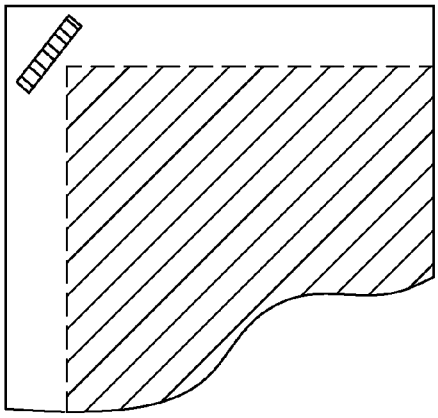
Figure 9D:
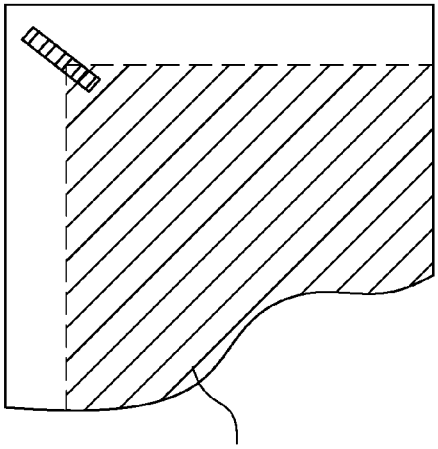

FIGS. 4A to 4D contain explanatory views of states of press-binding a bunch of sheets in the binding processing unit of FIG. 3, where FIG. 4A illustrates a position relationship between pressurizing surfaces and sheets, FIGS. 4B and 4C illustrate states in which the sheets are press-bound with the pressurizing surfaces, and FIG. 4D illustrates a cross-sectional state of a bunch of sheets subjected to press binding processing;

FIGS. 5A to 5C illustrate a control configuration for adjusting a pressurization force in binding processing operation in Embodiments 1 and 2, where FIG. 5A illustrates a state in which a pressurizing member is in a waiting position, FIG. 5B illustrates a state in which the member is in an actuation position, and FIG. 5C is an explanatory view of the control configuration for the pressurization force;

FIGS. 6A to 6F illustrate mesh states of a pair of pressurizing surfaces for press-binding sheets in the invention, where FIG. 6A illustrates an operation state in which the pair of pressurizing surfaces pressurize with a wide engagement area, FIG. 6B illustrates a mesh trace of FIG. 6A, FIG. 6C illustrates the case of displacing the position of the pressurizing surface in the binding width direction, FIG. 6D illustrates a mesh trace of FIG. 6C, FIG. 6E illustrates the case of displacing the position in the mesh length direction, and FIG. 6F illustrates a mesh trace of FIG. 6E;

FIG. 7 is an explanatory view of a control configuration in the image formation system of FIG. 1;

FIG. 8 is a flowchart illustrating a procedure of binding processing operation in Embodiment 1; and FIGS. 9A to 9D contain explanatory views of binding processing states of a bunch of sheets in a conventional press binding mechanism, where FIG. 9A shows the case where a press binding length is made long, FIG. 9B shows the case where the press binding length is made short, FIG. 9C shows the case where the press binding direction is set at a 45-degree sheet corner, and FIG. 9D shows the case where the press binding direction is set at a 135-degree sheet corner.

BEST MODE FOR CARRYING OUT THE INVENTION

The present invention will specifically be described below based on Embodiments as shown in drawings. FIG. 1 shows an image formation system according to the invention, and the system is comprised of an image formation apparatus A that forms an image on a sheet, and a post-processing apparatus B that performs post-processing such as binding processing on image-formed sheets to store. A sheet binding apparatus C that performs binding processing on collected sheets is incorporated into the post-processing apparatus B as an optional unit.

[Image Formation System]

The image formation system as shown in FIG. 1 will be described. The image formation system as shown in the figure is comprised of the image formation apparatus A and post-processing apparatus B, and the sheet binding processing C is incorporated into the post-processing apparatus. The image formation apparatus will be described below.

The image formation apparatus A is comprised of a paper feed section 1, image formation section 2, sheet discharge section 3 and signal processing section (not shown), and is incorporated into an apparatus housing 4. The paper feed section 1 is comprised of a plurality of cassettes 5 that stores sheets, and is configured to be able to store sheets of different sizes. Into each of the cassettes 5 are incorporated a paper feed roller 6 that feeds out the sheet, and a separation section (separation hook, separation roller, etc.; not shown) for separating sheets on a sheet-by-sheet basis.

Further, the paper feed section 1 is provided with a paper feed path 7 to feed a sheet from each cassette 5 to the image formation section 2. A register roller pair 8 is provided at the path end of the paper feed path 7 to align the front end of the sheet fed from each cassette 5, while causing the sheet to wait until the sheet is fed corresponding to image formation timing of the image formation section 2.

As the image formation section 2, it is possible to adopt various image formation mechanisms that form an image on a sheet. The section as shown in the figure indicates an electrostatic type image formation mechanism. As shown in FIG. 1, a plurality of drums 9 each comprised of a photoconductor is disposed in the apparatus housing 4 corresponding to color components. In each of the drums 9 are disposed an emitter (laser head or the like) 10 and developing device 11. Then, the emitter 10 forms a latent image (electrostatic image) on each drum 9, and the developing device 11 adds toner ink. The ink image added onto each drum is transferred to a transfer belt 12 for each color component, and the image is synthesized.

The transfer image formed on the belt is transferred to the sheet fed from the paper feed section 1 by a charger 13, is fused by a fuser (heat roller) 14, and then is fed to the sheet discharge section 3. The sheet discharge section 3 is comprised of a sheet discharge outlet 16 formed in the apparatus housing 4 to carry out the sheet to sheet discharge space 15, and a sheet transport path 17 to guide the sheet from the image formation section 2 to the sheet discharge outlet. In addition, a duplex path 18, described later, is connected to the sheet discharge section 3 to reverse the side of the sheet with the image formed on the frontside so as to feed again to the image formation section 2.

"D" shown in the figure denotes an image read unit, and is comprised of a platen 19*a*, and a read carriage 19*b* that reciprocates along the platen. "E" shown in the figure denotes an original document feed unit, and is comprised of a transport mechanism which feeds original document sheets set on a paper feed tray to the platen 19*a* on a sheet-by-sheet basis and stores on a sheet discharge tray 20 after reading the image.

[Post-processing Apparatus]

Figure 2:
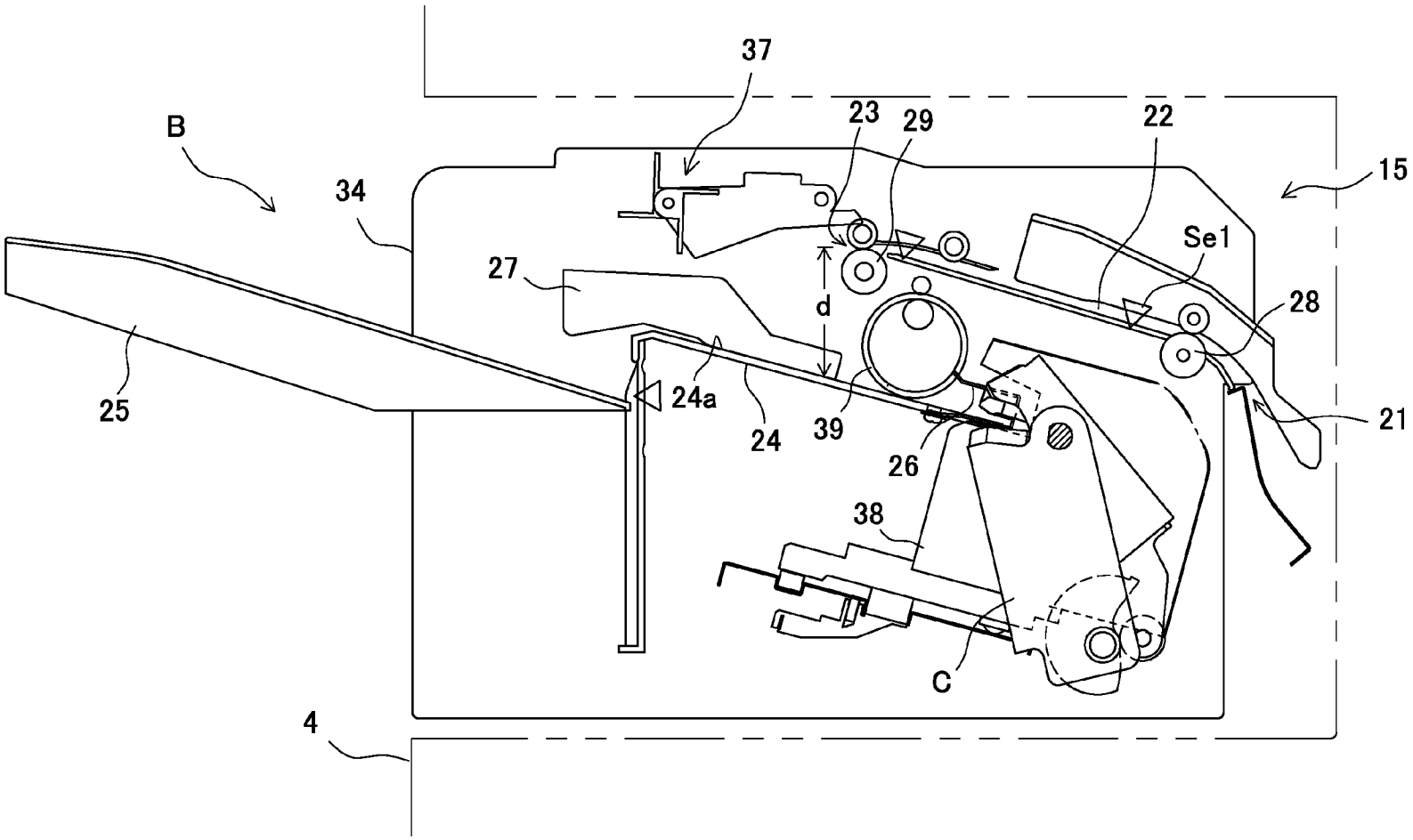
FIG. 2 is a detailed explanatory view of the post-processing apparatus in the image formation system of FIG. 1.

The post-processing apparatus B as shown in FIGS. 1 and 2 will be described next. The post-processing apparatus B as shown in the figure includes the built-in binding unit C (sheet binding apparatus; the same in the following description), and is configured as a terminal apparatus of the image formation system.

In FIG. 2, the post-processing apparatus B is comprised of an apparatus housing 34, a sheet transport path 22 disposed in the housing, a processing tray 24 (sheet support section; the same in the following description) disposed on the downstream side of a sheet discharge outlet 23 of the path, and a stack tray 25 disposed on the downstream side of the tray 24.

In the processing tray 24 are disposed a carry-in section 37 that carries a sheet in, and a position regulating section (sheet end regulating member 26 and side edge alignment member 27) that positions the carried-in sheet in a predetermined post-processing position (binding position) P. In the processing tray 24 is disposed a sheet binding section 49 (press binding section) that performs binding processing on a bunch of sheets. The configuration of the press binding section 49 will be described later. Together with the press binding section 49, in the processing tray 24 as shown in the figure is disposed a staple binding section 38 that performs binding processing on sheets. Sheets collected on the tray undergo press binding or staple binding with the designated section (by mode setting of an operator).

As shown in FIG. 2, in the apparatus housing 34 is disposed the sheet transport path 22 having a carry-in entrance 21 and sheet discharge outlet 23, and the path shown in the figure is configured to receive a sheet in the horizontal direction, and transport in an approximately horizontal direction to carry out of the sheet discharge outlet 23. Into the sheet transport path 22 is incorporated a transport mechanism (transport roller and the like) that transports the sheet.

The above-mentioned transport mechanism is comprised of transport roller pairs at predetermined intervals corresponding to the path length, a carry-in roller pair 28 is disposed near the carry-in entrance 21, and a sheet discharge roller pair 29 is disposed near the sheet discharge outlet 23. The carry-in roller pair 28 and sheet discharge roller pair 29 are coupled to the same drive motor (not shown), and transport a sheet at the same velocity. Further, in the sheet transport path 22 is disposed a sheet sensor Se1 that detects at least one of the front end and rear end of the sheet.

On the downstream side of the sheet discharge outlet 23 of the sheet transport path 22, the processing tray 24 is disposed while forming a level difference d. In order to collect sheets fed from the sheet discharge outlet 23 upward to collect in the shape of a bunch, the processing tray 24 is provided with a paper mount surface 24*a* that supports at least a part of sheets. The processing tray 24 is configured to collect sheets fed from the sheet discharge outlet 23 in the shape of a bunch, align in a predetermined posture, then perform binding processing, and carry out the processed bunch of sheets to the stack tray 25 on the downstream side.

A sheet carry-in section 37 (paddle rotating body) is disposed in the sheet discharge outlet 23, and transports the sheet to a predetermined position on the processing tray 24. Further, in the processing tray 24 is disposed a take-in transport section 39 that guides the sheet front end to the sheet end regulating member 26.

The take-in transport section 39 is disposed on the upstream side of the sheet end regulating member 26, and the section shown in the figure is comprised of a belt member in the shape of a ring. The belt member 39 engages in the uppermost sheet on the paper mount surface, and rotates in a direction for transporting the sheet toward the sheet end regulating member 26.

The sheet end regulating member 26 that positions the sheet is provided in the front end portion (rear end portion in the sheet discharge direction in the tray as shown in the figure) of the processing tray 24. Then, the member strikes the sheet, which is carried in from the sheet discharge outlet 23 with the take-in transport section 39, to regulate. The sheet end regulating member 26 aligns sheets collected on the processing tray in a predetermined processing position.

Further, in the processing tray 24 is disposed the side edge alignment member 27 that positions the width direction of the sheet positioned with the sheet end regulating member 26 in a reference line. The side edge alignment member 27 shown in the figure aligns the width of the sheet, which is fed from the sheet discharge outlet 23 and positioned with the sheet end regulating member 26, in a sheet-discharge orthogonal direction. The side edge alignment member 27 is comprised of a pair of right and left alignment plates, and positions the sheet in a predetermined reference line (center reference or side reference). The member as shown in the figure shows the case of setting in the center reference to position the sheet width direction with reference to the sheet front end.

In the processing tray 24 is disposed the press binding section 49 and staple binding section 38 that perform binding processing on sheets which are struck by the sheet end regulating member 26 to regulate and are positioned in the width direction by the side edge alignment member 27. The sheet binding processing mechanism and binding processing operation by the staple binding section 38 has already been known well, and therefore, the description thereof is omitted.

[Press Binding Section]

The press binding section 49 (sheet binding processing apparatus) according to the present invention will be described according to FIG. 3. The press binding section 49 applies narrow pressure from the frontside and backside directions of sheets with a pair of pressurizing surfaces to perform binding processing.

The mechanism is comprised of a pair of pressurizing surfaces 31, 41 for applying narrow pressure to bunch-shaped sheets from the frontside and backside directions, a pair of pressurizing members 30, 40 respectively provided with the pressurizing surfaces, and a drive mechanism (driver) PM that shifts the pressurizing surface 41 of one of the pressurizing members from a waiting position (non-pressurization position; the same in the following description) separated from the sheets to a pressurization position for pressurizing the sheets. The pressurizing members as shown in the figure are comprised of frame members (unit frame, bracket or the like), the first pressurizing member 30 is integrally fixed to the apparatus frame, and the second pressurizing member 40 is axially supported by a shaft 42 swingably with respect to the first pressurizing member 30.

In the Embodiment as shown in the figure, the section is comprised of the fixed-side pressurizing member 30 having the pressurizing surface 31 on the fixed side, the movable-side pressurizing member 40 having the pressurizing surface 41 on the movable side, and the drive mechanism PM that shifts the movable-side pressurizing surface from the waiting position separated from the sheets to the pressurization position for pressurizing the sheets.

The fixed-side pressurizing member 30 (hereinafter, referred to as "fixed member") and movable-side pressurizing member 40 (hereinafter, referred to as "movable member") are configured to cramp a bunch of sheets supported on the pressurizing surface 31 (hereinafter, referred to as "fixed surface") of the fixed member 30 with the pressurizing surface 41 (hereinafter, referred to as "movable surface") of the movable member 40. Therefore, the movable member 40 is axially supported to be swingable on a shaft 42 as the center, and the shaft 42 is fixed to the fixed member 30. The shaft 42 may be fixed to another member such as a unit frame, instead of being limited to the fixed member 30.

Further, the fixed member 30 is integrally fixed to the unit frame 46. Then, by operation that the movable member 40 performs swing motion on the shaft 42 as the center, the fixed surface 31 and movable surface are shifted to positions between a pressurization state (pressurization position) for cramping a bunch of sheets and a non-pressurization state (waiting position) separated from the bunch of sheets.

In the apparatus as shown in FIG. 1, the fixed member 30 is formed of a frame member (metal, reinforced resin or the like) in the shape of a "U" (channel shape) in cross section, and the movable member 40 is supported between its side walls 30*a*, 30*b* swingably by the shaft 42. Thus, the movable member 40 is guided by the side walls 30*a*, 30*b* of the fixed member 30 and performs swing motion on the shaft 42 as the center. Then, in the movable member 40 is disposed a return spring 43 for biasing to the waiting position side. The return spring 43 is disposed between the member 40 and the unit frame 46 (or the fixed member 30).

At least one of the fixed surface 31 and movable surface 41 is comprised of a concavo-convex surface (protrusion-groove) to deform the pressurized sheets. In the surfaces as shown in the figure, each of the fixed surface 31 and the movable surface 41 is formed of the concavo-convex surface, and the shape is configured so that convex portions and concavo portions mesh with one another. In consideration of the shape (particularly, edge shape) that does not provide sheets with damage in pressurizing, the shape of each of the concavo-convex surfaces is configured in an optimal shape such that overlapped sheets concurrently mesh with one another to deform. Then, deformation in the shape of gathers (shape of waves) is left in the sheets narrow-pressed with the concavo-convex surfaces, and overlapped sheets are bound.

The drive mechanism of the above-mentioned movable member 40 will be described. The movable member 40 supported swingably by the fixed member 30 is comprised of the movable surface 41 at the front end portion and a cam follower 44 (hereinafter, referred to as "follower roller") at the base end portion with the shaft 42 as a boundary. The movable surface 41 at the front end and follower roller 44 are formed in a lever length such that action (booster mechanism) of a lever works through the shaft 42.

Further, a cam member 33 (in the apparatus shown in the figure, cylindrical cam) is disposed at the base end portion of the fixed member 30. The cam member 33 is supported by a cam shaft 32, the cam shaft 32 is axially supported by the fixed member 30 rotatably, and the cam member 33 and follower roller 44 are disposed in the position relationship that the member and roller are mutually engaged. Further, rotation of the drive motor DC is transferred to the camshaft 32 via a transmission section 35, and coupling is made so that the cam member 33 rotates forward and backward by forward and backward rotation of the drive motor.

As shown in FIG. 3, the drive motor DC is mounted on the unit frame 46, and rotation of a drive shaft 36 thereof is transferred to the cam shaft 32 via transmission gears G2, G3, G4, G5 constituting the transmission section 35. The cam member 33 rotates in a counterclockwise direction as viewed in FIG. 3 by the gear G1 coupled to the camshaft 32. In the apparatus as shown in the figure, the cam member 33 is configured to repeat counterclockwise rotation (CCW) and clockwise rotation (CW) in a predetermined angle range by forward and backward rotation of the drive motor DC. Then, a cam surface 33*a* of the cam member 33 causes the follower roller 44 and movable member 40 integral with the roller 44 to perform swing motion on the shaft 42 as the center.

In the drive mechanism of FIG. 3, when the drive motor DC is rotated in a counterclockwise direction, the movable member 40 swings in a counterclockwise direction on the shaft 42 as the center, and the movable surface 41 shifts from the waiting position Wp to the pressurization position Ap. Further, a non-engagement portion is formed on the cam surface 33*a*, and in this position, the movable member 40 is biased to the waiting position Wp by action of the return spring 43 without undergoing action of the cam surface 33*a*.

Then, the drive motor DC is rotated in a clockwise direction and is halted in a position in which the non-engagement portion cps of the cam surface 33*a* and follower roller 44 are engaged in each other. Then, by the spring force of the return spring 43, the movable surface 41 shifts from the pressurization position Ap to the waiting position Wp, and is halted in this position.

In "Cs" position as shown in FIG. 5A, the cam surface 33*a* holds the movable surface 41 in the waiting position Wp, without acting the swing force on the follower roller 44. Further, in "Ce" position as shown in FIG. 5B, the cam surface 33*a* provides the follower roller 44 with an action force such that the movable member 40 swings in a counterclockwise direction. Near this Ce2 position (which differs according to the thickness of a bunch of sheets), the movable surface 41 starts pressurization on the sheets. Then, in "Ce1", although the position differs according to a bunch thickness of a bunch of sheets, the maximum pressurization force is acted upon the sheets S in this position, and pressurization operation is finished. Subsequently, by clockwise rotation of the cam member 33, the surface performs return operation in the order of "Ce1", "Ce2" and "Cs".

Then, the cam surface 33*a* is formed in the shape of a "helicoil" such that the pressurization force gradually increases between the initial position (Cs) in which the movable surface 41 pressurizes a bunch of sheets S and the pressurization finish position (Ce). This is because of acting almost the same pressurization force even when the thickness of the bunch of sheets is different between the fixed surface 31 and the movable surface 41.

[Pressurization Force Adjustment of the Pressurizing Surfaces]

Described next is sheet binding processing operation by the press binding section 49 as described above. The press binding section 49 disposed on the processing tray 24 waits, with a state in which a pair of upper and lower pressurizing surfaces 31, 41 are separated from each other as shown in FIG. 5A as a home position, in the position. In this waiting position Wp, a sheet is carried onto the processing tray 24, a plurality of sheets is positioned by the position regulating sections 26, 27 to be loaded and collected, and bunch-shaped sheets are set in between a pair of pressurizing surfaces 31, 41.

The pair of pressurizing surfaces 31, 41 are supported by the pressurizing members (fixed-side pressurizing member 30 and movable-side pressurizing member 40), and shift from the waiting position Wp where the surfaces are separated from each other to the actuation position Ap (actuation state of FIG. 5B). At this point, the bunch of sheets is pressurized by the pair of pressurizing surfaces 31, 41, and the sheets are mutually deformed, and at the same, are pressed to be bound. The binding among the sheets is due to the fact that fiber components among sheets become mutually entangled and that plastic deformation occurs in the concavo-convex shape in the overlapped state. Accordingly, as the engagement area of the pressurizing surfaces 31, 41 and the sheets increase, the binding force increases.

In the pressurizing surfaces 31, 41 as shown in the figure, pluralities of concavities and convexities are formed with a predetermined length (binding length; L) and predetermined width (binding width; W) at predetermined angles (angle $\alpha$, angle $\beta$) with respect to the sheet corner in the state of FIG. 4A. Hereinafter, in the present invention, the "binding length L" is assumed to be the entire length dimension of a plurality of consecutive concavo-convex tooth forms, and the "binding width W" is assumed to be the width dimension of each of the concavo-convex tooth forms.

Described next is the pressurization force of the pressurizing surfaces 31, 41 on sheets. The movable-side pressurizing member 40 applies narrow pressure to sheets to perform binding processing when the member 40 rotates from the waiting position of FIG. 5A to the actuation position of FIG. 5B. Therefore, the movable-side pressurizing member 40 is provided with the cam member 33, and by controlling rotation of the drive motor DC coupled to the cam, reciprocates between the waiting position Wp and the actuation position Ap.

At this point, a control section 50 described later adjusts the level of the pressurization force acted on the pressurizing surfaces 31, 41 by controlling the rotation angle (Ce1 and Ce2 in FIG. 5B) of the cam member 33. The control configuration will be described according to FIG. 5C.

The drive motor DC as shown in the figure is comprised of a direct-current motor, and by adjusting a current value to supply to a motor driver 51, the control section 50 adjusts the pressurization force. Two-step pressurization force adjustments shown in the figure will be described. When "strong binding" is set by mode setting of an operator, the control section 50 sets a current value to supply to the drive motor DC at "A(>B)" amperes. On the other hand, when "weak binding" is set by an operator, the control section 50 sets a supply current value at "B(<A)" amperes. These current values were beforehand set by experiments and stored in a storage section (RAM 54 or the like).

Then, the control section 50 reads the pressurization force Fp (load torque) and pressurization time Tp which were beforehand set and stored in the storage section (RAM) 54. Then, when the operator sets at "strong binding", the section 50 reads the current value A from the RAM 54. Similarly, when the operator sets at "weak binding", the section 50 reads the current value B from the RAM 54.

Then, the control section 50 compares the reference current value (A or B) that corresponds to the pressurization force Fp designated by the operator with a detection value from a current detection section (circuit) 52 that detects the back electromotive force of the drive motor DC, and controls so as to supply a set current value to the motor. By this control, the drive motor DC continues rotation until the current value reaches the predetermined reference current value (A, B), and is halted when the torque acted upon the motor reaches a predetermined value. At this point, the cam member 33 is halted at the rotation angle Ce1 (current value A; strong binding) as shown in FIG. 5B, or the rotation angle Ce2 (current value B; weak binding).

[Pressurization Time]

The control section 50 sets the pressurization time Tp corresponding to a state of a bunch of sheets to perform binding processing. This is because of needing the time for pressurizing to cause plastic deformation in the sheets in pressurizing and deforming a plurality of sheets to bind so that the sheets mesh with one another. When the pressurization time Tp is set to be long, the sheets are deformed so as to mesh with one another reliably, and the meshed state is maintained. When the pressurization time Tp is short, the sheets are not deformed until the mesh, or are restored to the original shape.

Then, the control section 50 as shown in the figure is configured to set the pressurization time according to at least one condition of (1) bunch thickness, (2) the number of sheets and (3) sheet material of sheets to perform binding processing. This is because when the sheet bunch is thick, the deformation amount of sheets decreases in proportion to the thickness (due to the effect of the volume amount of sheets to deform), and when the number of sheets is high, the deformation amount of the sheets decreases in proportion to the number of sheets (due to the effect of an air layer between sheets). The description of the specific configuration thereof is omitted.

Described next is control of the drive motor DC that rotates the cam member 33 of the pressurizing member 30 as described previously. The drive motor DC is coupled to the cam member 33, the cam member 33 is rotated by rotation of the motor, and the movable-side pressurizing member 40 provided with the cam follower 44 swings at a predetermined angle on the shaft 42 as the center. By this operation, the movable-side pressurizing surface 41 (movable surface) shifts from the waiting position Wp to the actuation position Ap, and presses the fixed-side pressurizing surface 31 to contact.

[Engagement Area Adjustment of the Pressurizing Surfaces]

The present invention is characterized by enabling the binding strength to be adjusted in applying narrow pressure to a bunch of sheets with a pair of pressurizing surfaces 31, 41 to perform binding processing in the above-mentioned press binding mechanism. The above-mentioned first pressurizing surface 31 and second pressurizing surface 41 are configured to enable binding (strong binding mode) hard to peel with a wide mesh area or binding (weak binding mode) easy to peel with a narrow mesh area to be selected and set. The configuration will be described below according to FIGS. 6A to 6F.

FIG. 6A illustrates a state in which all of the first pressurizing surface 31 and second pressurizing surface 41 mesh with each other (strong binding mode). In this case, narrow pressure is applied to sheets with a predetermined area Sq1 (area of the entire pressurizing surface) to perform binding processing. In this case, as shown in FIG. 6B, a press-binding deformed portion (area Sq1) in the shape of gathers is formed in the sheets. The press-binding deformed portion (press-binding area and concavo-convex depth) is set for binding strength hard to peel with a predetermined sheet material and a predetermined bunch thickness in apparatus design.

FIG. 6C illustrates a form for displacing the position of one of the first pressurizing surface 31 and second pressurizing surface 41 by a predetermined amount (δy) in the binding width direction (W) to mesh (Embodiment 1 of weak binding mode). In this case, as shown in FIG. 6D, a press-binding deformed portion (area Sq2; <Sq1) in the shape of gathers is formed in the sheets. The area (Sq2) of the press-binding deformed portion is set at an area such that the sheets are not peeled in normal page turning and are capable of being peeled with ease when the user peels by stronger force.

FIG. 6E illustrates a form for displacing the position of one of the first pressurizing surface 31 and second pressurizing surface 41 by a predetermined amount (δx) in the binding length direction (L) to mesh (Embodiment 2 of weak binding mode). In this case, as shown in FIG. 6F, a press-binding deformed portion (area Sq3; <Sq1) in the shape of gathers is formed in the sheets. The area (Sq3) of the press-binding deformed portion is set at an area such that the sheets are not peeled in normal page turning and are capable of being peeled with ease when the user peels by stronger force.

As described above, in fact, a control section 50 described later positions the first and second pressurizing surfaces 31, 41 to mesh in the state of FIG. 6A when the "strong binding mode" is set by setting of an operator, and when the "weak binding mode" is set, positions the first and second pressurizing surfaces 31, 41 to mesh in the state of FIG. 6C or FIG. 6E.

At this point, FIG. 6C is to change the engagement area of the pressurizing surfaces in the mesh width direction (W), and FIG. 6E is to change the engagement area in the mesh length direction (L). Accordingly, in Embodiment 1, the control section 50 is configured so that a pair of pressurizing surfaces perform mesh operation in the state of FIG. 6A or the state of FIG. 6C. Further, in Embodiment 2, the control section 50 is configured so that a pair of pressurizing surfaces perform mesh operation in the state of FIG. 6A or the state of FIG. 6E.

In Embodiment 1, the binding-processed sheets are bound with the same binding length (L) in both of strong and weak binding modes, and with the binding width (W0, W1) being wide or narrow. At this point, when the width direction is wide, the binding is hard to peel, while when the width direction is narrow, being easy to peel. Further, in Embodiment 2, the binding-processed sheets are bound with the same binding width (W) in both of strong and weak binding modes, and with the binding length (L0, L1) being long or short. When the length direction is long, the binding is hard to peel, while when the length direction is short, being easy to peel.

According to FIG. 3, described is the mechanism for changing the mesh area of the pressurizing surface 31 (the same in the pressurizing surface 41). As described previously, the fixed-side pressurizing surface 31 is attached to the fixed pressurizing member 30 (frame member, bracket member of the like). At this point, a guide member is provided in the fixed pressurizing member, and along the guide member, the fixed pressurizing surface 31 (plate member or block member) shifts to positions (δx, δy) between the first position and the second position.

A rack (guide member) 60 is formed in the fixed pressurizing surface 31, and meshes with a fan-shaped gear 59 axially supported by the fixed pressurizing member 30. Then, the fan-shaped gear 59 is coupled to the drive motor DC with a transmission belt (shift section) 58' via an electromagnetic clutch 58. The electromagnetic clutch 58 transfers rotation of the motor to the cam member 33 or to the fan-shaped gear 59 to selectively transfer and drive (switch driving).

[Control Configuration]

Described next is a control configuration of the image formation system as shown in FIG. 1. The control section 50 as shown in FIGS. 9A to 9D is comprised of an image formation control section 45 that controls the image formation unit, and the post-processing control section 50. The image formation control section 45 is comprised of a mode selecting section 48 and input section 47. The input section 47 sets image formation conditions, and at the same time, sets a binding processing mode. The binding processing mode is to select executing the binding processing with the first binding section (staple binding section) 38 or executing the binding processing with the second binding section (sheet binding section) 49.

The post-processing control section 50 is comprised of a post-processing control CPU, and reads execution programs stored in ROM 53 to execute post-processing operation. Further, the RAM 54 stores control data such as the pressurization time Tp of the binding operation by the second binding section C as described previously.

The control CPU 50 is comprised of a collection control section 50*a*, binding processing control section 50*b*, and stack control section 50*c*. The collection control section 50*a* collates and collects sheets fed from the image formation apparatus A on the processing tray 24. The binding processing control section 50*b* controls the stapler binding section 38 to perform the binding operation when the first binding processing mode is selected. On the other hand, when the second binding processing mode is selected, the section 50 controls the press binding section 49 to perform the binding operation.

At this point, when the press binding processing mode is selected, the control section 50 changes the sheet processing position on the processing tray or shifts the position of the binding processing unit C, corresponding to the binding processing strength set by the operator, for example, "book-binding (strong binding)" or "simple binding (weak binding)".

[Binding Processing Operation]

Described is a control flow of the post-processing operation as shown in FIG. 8. When the apparatus power supply is turned ON, the control section 50 executes initializing operation (St01). By this operation, the control section 50 positions the pressurizing members 30, 40 in the waiting position Wp, and shifts the sheet end regulating member 26 to the home position. This position is detected with a home position sensor.

Next, the control section 50 waits for mode setting of the operator. In the system of FIG. 1, the binding processing mode is set at any of the press binding mode, staple binding mode and print out mode. When the staple binding mode and print out mode are selected, although the description thereof is omitted, the section 50 executes the respective processing operation (St03).

When the press binding processing is selected in the above-mentioned setting (St04), the control section 50 determines whether or not the processing is "strong binding" designation or "weak binding" designation (St05). In the "strong binding" designation, the section 50 shifts the first pressurizing surface 31 to the position (state of FIG. 6A) in which the entire surface engages with the opposed pressurizing surface 41 without any portion that is not meshed (St06). For this shift, the section 50 rotates the drive motor DC as described previously, and performs on-off control so that the electromagnetic clutch 58 transfers the driving force to the fan-shaped gear 59. The rotation direction of the motor is set at a rotation direction with reference to a detection signal of the home position sensor of the pressurizing surface 31, not shown.

Then, the image formation apparatus A on the upstream side forms an image (St07), and the post-processing apparatus B carries the sheet in the sheet transport path 22. This sheet is carried (St08) in the processing tray 24 from the transport path 22 to the downstream side.

In the "weak binding" designation in the above-mentioned determination, the control section 50 shifts the first pressurizing surface 31 to the position of the state of FIG. 6C or FIG. 6E. For this shift, the section 50 rotates the drive motor DC as described previously, and performs on-off control so that the electromagnetic clutch 58 transfers the driving force to the fan-shaped gear 59. The rotation direction of the drive motor DC is set at a rotation direction with reference to a detection signal of the home position sensor of the pressurizing surface 31, not shown (St09). Then, the image formation apparatus A on the upstream side forms an image (St07), and the post-processing apparatus B carries the sheet in the sheet transport path 22. This sheet is carried in the processing tray 24 on the downstream side from the transport path 22 (St08).

The sheet, which is thus fed from the sheet transport path 22 and is positioned on the processing tray 24 with the sheet end regulating section 26, is aligned with the side edge regulating member 27 so that the posture in the width direction is positioned in a predetermined reference (St10). Next, the control section 50 receives a job end signal of image formation from the image formation apparatus (St11). Subsequently, the control section 50 issues a binding operation instruction signal to the binding processing section 49. Upon receiving the signal, the binding processing section 49 executes the binding processing operation (St12). Next, the control section 50 transports a bunch of sheets subjected to the binding processing from the processing tray 24 to the stack tray 25 on the downstream side to store (St13).

In addition, in the present invention, the case is described where the press binding unit (section) 49 performs press-binding with the "wide area" in the "strong binding", while performing press-binding with the "narrow area" in the "weak binding" by designation of the operator, but one of "wide area press-binding" and "weak binding" may be set automatically corresponding to a bunch thickness of sheets or a sheet size. Further, the invention is not limited to the case of changing the press-binding area in two steps, and it is also possible to set a different press-binding area in three or more steps or in a non-step manner.

The invention claimed is:

1. A sheet binding processing apparatus for performing press binding, comprising:

first and second pressurizing surfaces opposed to each other with a plurality of sheets nipped therebetween;

a pressurization driver to shift a position of at least one of the first and second pressurizing surfaces from a waiting position where the plurality of sheets is set to an actuation position for press binding the plurality of sheets by press-contact; and a shift section arranged so that one of the pressurizing surfaces is shifted to positions relatively to the other one of the pressurizing surfaces to thereby adjust an engagement area of the pair of pressurizing surfaces to be wide or narrow.

2. A post-processing apparatus comprising:

a processing tray adapted to load and store sheets sequentially;

a sheet binding processing unit disposed on the processing tray; and a stack tray adapted to store sheets carried out of the processing tray, wherein the sheet binding processing unit is the sheet binding processing apparatus according to claim 1.

3. The sheet binding processing apparatus according to claim 1, wherein the shift section moves the first and second pressurizing surfaces relatively in a direction crossing a direction wherein the pressurization driver shifts at least one of the first and second pressurizing surfaces from the waiting position to the actuation position.

4. The sheet binding processing apparatus according to claim 3, wherein the first and second pressurizing surfaces are comprised of convex tooth forms and concavo tooth forms that mesh with one another with a predetermined mesh width in a shape that a plurality of forms is arranged in a predetermined mesh direction.

5. The sheet binding processing apparatus according to claim 3, wherein in the first and second pressurizing surfaces, one of the pressurizing surfaces is able to shift to positions relatively to the other one in the mesh width direction.

6. The sheet binding processing apparatus according to claim 3, wherein in the first and second pressurizing surfaces, one of the pressurizing surfaces is disposed in a first member, the other one of the pressurizing surfaces is disposed in a movable member attached to the frame member swingably, and the pressurization driver is coupled to the movable member.

7. The sheet binding processing apparatus according to claim 6, wherein the one of the pressurizing surfaces that shifts to positions is supported by a guide member disposed in the frame member to be able to shift to positions.

8. The sheet binding processing apparatus according to claim 1, wherein the shift section automatically moves the first and second pressurizing surfaces relatively according to a bunch thickness of sheets or a sheet size.

* * * * *